United States Patent [19]

Olds et al.

[11] Patent Number: 4,494,260

[45] Date of Patent: Jan. 22, 1985

[54] BODY SUPPORT

[76] Inventors: Peter J. Olds, 81 Adelaide St., Maryborough, Queensland, 4650; Richard S. Blakeway, 81 Spitfire Crescent, Strathpine, Queensland, 4500, both of Australia

[21] Appl. No.: 447,322

[22] Filed: Mar. 21, 1983

[30] Foreign Application Priority Data

Mar. 25, 1982 [AU] Australia ..... PF3304

[51] Int. Cl.[3] ..... A61G 7/10

[52] U.S. Cl. ..... 5/446; 5/60; 5/109; 128/33; 128/52

[58] Field of Search ..... 5/60, 446, 447, 108, 5/109; 128/33, 52

[56] References Cited

U.S. PATENT DOCUMENTS

| | | | |
|---|---|---|---|
| 1,643,793 | 9/1927 | Sparhawk | 5/60 |
| 2,773,498 | 12/1956 | Himmelman | 5/60 |
| 2,906,259 | 9/1959 | Adar, Jr. | 5/60 |
| 3,464,406 | 9/1969 | Kunce . | |
| 3,882,556 | 5/1975 | Accurso | 5/109 |
| 3,889,472 | 6/1975 | Guillaud . | |
| 4,070,831 | 1/1978 | Rutz . | |
| 4,154,232 | 5/1979 | Fukazawa | 128/52 |
| 4,192,296 | 3/1980 | St, Mary | 128/52 |
| 4,202,326 | 5/1980 | Van Gerpen | 128/33 |
| 4,222,137 | 9/1980 | Usami | 5/446 |
| 4,267,610 | 5/1981 | Blakeway et al. | 5/60 |

FOREIGN PATENT DOCUMENTS

| | | | |
|---|---|---|---|
| 943834 | 12/1963 | United Kingdom | 5/60 |
| 1009787 | 11/1965 | United Kingdom | 5/60 |
| 1385249 | 2/1975 | United Kingdom | 5/238 |

*Primary Examiner*—Alexander Grosz
*Assistant Examiner*—Michael F. Trettel
*Attorney, Agent, or Firm*—Schwartz, Jeffery, Schwaab, Mack, Blumenthal & Koch

[57] ABSTRACT

A body support applicable to a hospital bed, seat or the like includes a substantially horizontal frame on which a series of carriers are mounted for oscillation about parallel axes transverse of the frame, substantially rectangular-section support blocks of resiliently yieldable material being mounted on the carriers, drive means being provided for oscillating the carriers and the support blocks mounted thereon in unison to tilt the upper faces of the support blocks alternately in both directions from horizontal, varying the pressure applied by all parts of a body supported by the support blocks.

3 Claims, 5 Drawing Figures

BODY SUPPORT

BACKGROUND OF THE INVENTION

1. Field of the Invention

This invention relates to an improved body support.

2. Brief Description of the Prior Art

A known type of hospital bed includes a series of parallel horizontal resiliently yieldable rollers located between and in contact with a top sheet tensioned above a frame, and a plate which is reciprocal longitudinally with respect to the bed and is moved back and forth by a drive mechanism so that the rollers are fairly slowly advanced and retracted to roll in one direction and the other under the sheet. The soft rollers form a comfortable support for a patient lying on the bed and, because of their motion under the fixed sheet, the pressure on supported parts of the body of the patient is alternately lessened and increased. Beds of this type have been found to be highly conducive to the comfort of patients who are immobilised. This system is applicable to other body supports also, such as seats of various kinds and operating tables.

These body supports, though generally very satisfactory, have certain disadvantages. They are fairly expensive to make and cannot easily be installed in existing beds, wheel chairs and the like, and the tensioned top sheet may be less yielding than is desirable, resulting in insufficient relief to patients at some pressure points such as heels and elbows. Such a system is not readily applicable to, for example, all sections of a hospital bed which are in hingedly adjustable relationships.

SUMMARY OF THE PRESENT INVENTION

The present invention has been devised with the general object of overcoming the said present disadvantages by providing a body support which is particularly effective in continuously varying the pressure between any part of it and the part of the body supported thereby. Other objects achievable in preferred embodiments of the invention are to provide such a body support which is very simple and economical to manufacture and maintain, which is readily applicable to an existing hospital bed, or wheel chair, for example, and which is sturdy, durable and trouble-free in use.

BRIEF DESCRIPTION OF THE INVENTION

According to the invention, a body support, such as a hospital bed, for example, includes a normally more or less horizontal and rectangular frame supporting a series of similar carriers arranged transversely of the frame, and pivoted for oscillation about parallel transverse axis. Mounted removably upon the carriers are support blocks, preferably substantially rectangular in cross-section and of a resiliently compressible material such as plastic foam. Certain of the support blocks may be comprised of a number, preferably three, of similar sections placed end to end. A drive mechanism is provided for causing the carriers, and the support blocks mounted thereon, to oscillate in unison, through a fairly small angle, the axis of oscillation of each carrier being fairly close to the top of the support block mounted thereon. A light throw-over mattress or other cover may be placed on top of the support blocks which, because of their oscillation, cause continuous variations in the pressure applied by all parts of a person supported on the cover. Sections of the support blocks made in end-to-end parts may be removed to enable a patient to use a bed pan or for treatment of some part of the body without undue disturbance of the patient, and all support blocks can be easily removed for cleaning, and replaced.

DETAILED DESCRIPTION OF THE PREFERRED EMBODIMENT

Figure 3:
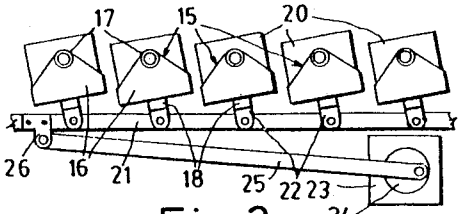
FIGS. 3, 4 and 5 are diagrammatic side views of carriers and support blocks of the bed at different stages of their oscillation.

The hospital bed illustrated has a horizontal rectangular outer frame 10 mounted on legs 11 and fitted with a bed-head 12 and foot 13. Within the outer frame 12 there is installed a body support assembly according to the invention and including a rectangular support frame of rigidly interconnected side members 14 between which are oscillatably mounted a series of similar transverse carriers 15. Each of the carriers 15 is of shallow box-like form, with relatively high ends 16 the side of which are upwardly convergent to apertured bosses 17, the bottom of the carrier being reinforced by a central stiffening bar 18 extending from end to end. Each carrier 15 is oscillatably mounted on a pair of pivots 19 extending inwardly from the side members 14 of the support frame. These pivots may be of a resiliently yieldable material such as fairly hard rubber, and engaging with considerable clearance in the apertured bosses 17 on the ends 16 of the carrier.

In each of the carriers 15 there is removably fitted a resiliently deformable support block 20, or three separate support block sections arranged end to end, as indicated at 20*a*. Each of these support blocks or support block sections may suitably be made of a plastic foam material of well-known type, and is of rectangular cross-section fitting closely between the sides of its carrier, with its top surface somewhat above the level of the carrier ends 16.

The carriers are all interconnected by a linking bar 21 extending centrally and longitudinally under the series of carriers and pivoted between pairs of apertured lugs 22 extending downwardly from the stiffening bars 18 of all of the carriers.

The linking bar may be reciprocated, so as to oscillate the carriers 15 in unison, by means of a small motor 23, which may be electric or hydraulic or of any other suitable type, driving an eccentric 24 connected by a connecting rod 25 to a clevis 26 on the linking bar 21.

Figure 4:
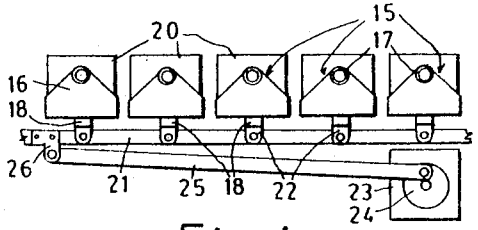
Figure 5:
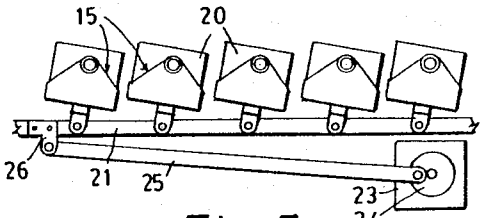
Figure 1:
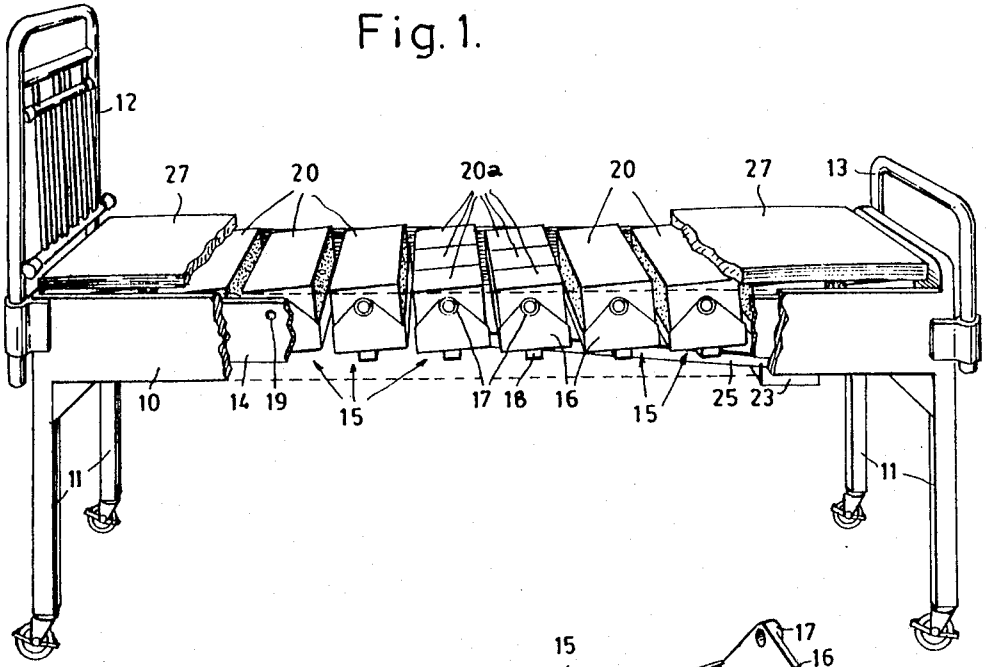
FIG. 1 is a partly broken-away perspective view of a hospital bed incorporating a body support according to the invention.
Figure 2:
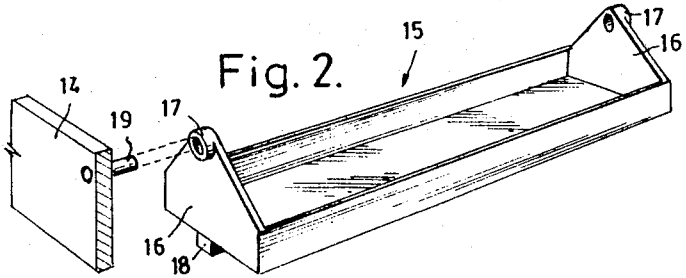
FIG. 2 is a perspective view of one of the oscillatable carriers of the bed.

With the support blocks 20 and block sections 21*a* in their median positions, their upper surfaces horizontal and co-planar as shown in FIG. 4, the bed is made up with bed-clothes in usual manner after the support blocks and block sections have been covered by a light mattress 27, the blocks being sufficiently close to provide a substantially complete support, yielding and spreading towards each other under the pressure applied. The motor 23 is operated to cause the carriers to oscillate slowly in unison so that their upper surfaces tilt alternately in one direction and the other, as indicated in FIGS. 3, 4 and 5. The blocks 20 and block sections 20 are more yieldable at their mostly unsupported sides than along their middle parts, and the effect upon each part of the body of a patient supported on the bed is of continuously, but slowly and gently, changing positions of maximum pressure. It is found that this is greatly conducive to the comfort of immobilised patients, and the very great reduction in the moving of a patient which is otherwise necessary for the prevention of bedsores.

The use of some of the carriers 15 of block sectiond 20*a*, any ones of which can be easily removed temporarily, greatly facilitates the use of a bed-pan, or the treatment of some area of the body, with minimum disturbance of the patient. If any one of the blocks or block sections should require cleaning, it may be easily removed and replaced, and its cleaning presents no difficulty. Any of the blocks may be removed and replaced by lower blocks, or may be raised by the insertion of supplementary blocks beneath them, where lowered or raised parts of the bed are desirable. Thus, raised blocks can be used instead of a pillow, to prevent or reduce the likelihood of soreness of the ears or other parts of the head. The oscillation of the blocks induces flow of air through the covering light mattress and bed clothes, greatly reducing the likelihood of their becoming moist and uncomfortable; and the beneficial effect of the oscillating blocks is felt over the whole of the body-supporting area of the bed.

The invention is applicable also to other body supports, for example wheel-chairs used by paraplegics and others, and may be applied to the back as well as the seat of such a chair. In such a case, a body support assembly may consist of a seat frame and a back frame, which may be hingedly or rigidly interconnected, each of these frames having a series of carriers and resiliently deformable blocks pivotally mounted between its sides, any suitable means being provided for oscillating the carriers and blocks in unison in each of the frames. The seat and back frames may be made for releasable engagement with the wheel chair so that the whole body support assembly may be readily removed to enable the wheel chair to be folded in usual manner.

The invention is likewise applicable to a hospital bed made in such manner that its head and foot sections may be hingedly raised or lowered. In this case the body support assembly is made in the required number of sections hingedly interconnected end to end, each with a series of the carriers and resilient support blocks, those of each section being linked for oscillation in unison, the oscillating means of the several sections being individually driven or operatively interconnected in any suitable way. For example the linking bar of one section, reciprocated by a motor, may also be connected to a hydraulic master cylinder connected to slave cylinders which are connected to the linking bars of the other sections so that, as the master cylinder is extended and retracted by the motordriven linkage bar, the slave cylinders are correspondingly extended and retracted to reciprocate the linking bars to which they are connected.

The invention may be applicable also to vehicle seats and to a variety of other body supports.

We claim:

1. A body support of the type having a plurality of resiliently yieldable support members mounted transversely of a substantially horizontal frame, and drive means for moving the support members in unison to vary the pressure on parts of a body supported thereby, wherein;

the support members are blocks of substantially rectangular cross-section, the support members are mounted on a series of carriers mounted on the frame for oscillation about a transverse axis, said carriers being of shallow box-like form adapted to receive removably the bottom parts of said support members, said carriers being further provided with elevated ends pivoted near to their tops to said frame for oscillation about axes through the upper parts of said support members, and wherein the drive means is adapted to oscillate the carriers and the support members mounted thereon in unison to tilt the upper surfaces of the support members alternately in opposite directions from substantially horizontal.

2. A body support according to claim 1 wherein at least one of said support members comprises a number of similar sections mounted end to end on a carrier and individually removable therefrom.

3. A body support according to claim 1 wherein said drive means includes a link pivotally connected to said carriers, and a motor on said frame driving an eccentric connected by a connecting rod to said link.

* * * * *